US007686941B2

(12) United States Patent
Brierley et al.

(10) Patent No.: US 7,686,941 B2
(45) Date of Patent: Mar. 30, 2010

(54) SIMULTANEOUS HYDROCRACKING OF MULTIPLE FEEDSTOCKS

(75) Inventors: Gary R. Brierley, Crystal Lake, IL (US); Vasant P. Thakkar, Elk Grove Village, IL (US); Milan Skripek, Murrieta, CA (US)

(73) Assignee: UOP LLC, Des Plaines, IL (US)

( * ) Notice: Subject to any disclaimer, the term of this patent is extended or adjusted under 35 U.S.C. 154(b) by 428 days.

(21) Appl. No.: 11/530,637

(22) Filed: Sep. 11, 2006

(65) Prior Publication Data

US 2008/0060976 A1 Mar. 13, 2008

(51) Int. Cl.
*C10G 45/00* (2006.01)

(52) U.S. Cl. ..... 208/58; 208/49; 208/57; 208/78

(58) Field of Classification Search ..... 208/57–58, 208/78, 80, 86, 89
See application file for complete search history.

(56) References Cited

U.S. PATENT DOCUMENTS

| | | | | |
|---|---|---|---|---|
| 3,328,290 A | | 6/1967 | Hengstebeck | 208/89 |
| 4,954,241 A | * | 9/1990 | Kukes et al. | 208/59 |
| 5,203,987 A | * | 4/1993 | de la Fuente | 208/59 |
| 5,403,469 A | | 4/1995 | Vauk et al. | 208/78 |
| 5,980,729 A | | 11/1999 | Kalnes et al. | 208/89 |
| 6,036,844 A | * | 3/2000 | Gupta et al. | 208/49 |
| 6,106,694 A | | 8/2000 | Kalnes et al. | 208/57 |
| 6,113,775 A | * | 9/2000 | Christolini et al. | 208/80 |
| 6,315,889 B1 | * | 11/2001 | Thakkar et al. | 208/59 |
| 6,638,418 B1 | * | 10/2003 | Kalnes et al. | 208/89 |
| 2004/0188328 A1 | * | 9/2004 | Turner | 208/210 |

OTHER PUBLICATIONS

Barman, B.N. (2005). Energy & Fuels, 19, 1995-2000.*
Speight, J. et al. (2002). Petroleum Refining Processes, Marcel-Dekker, 728 pgs. (p. 442 cited in Notice).*

* cited by examiner

*Primary Examiner*—Glenn A Caldarola
*Assistant Examiner*—Brian McCaig
(74) *Attorney, Agent, or Firm*—James C Paschall

(57) ABSTRACT

A process for simultaneously hydrocracking multiple feedstocks wherein a first feedstock is hydrotreated in a hydrotreating zone to produce a hydrotreating zone effluent which is separated to provide a first vaporous hydrocarbonaceous stream and a first liquid hydrocarbonaceous stream. The second feedstock and the first vaporous hydrocarbonaceous stream are hydroprocessed in a hydroprocessing zone to produce a hydroprocessing zone effluent. A third feedstock and the first liquid hydrocarbonaceous stream are hydrocracked in a hydrocracking zone to produce a hydrocracking zone effluent. The hydrocracking zone effluent and the hydroprocessing zone effluent are separated to recover hydrocracked hydrocarbons.

8 Claims, 1 Drawing Sheet

SIMULTANEOUS HYDROCRACKING OF MULTIPLE FEEDSTOCKS

BACKGROUND OF THE INVENTION

The field of art to which this invention pertains is the simultaneous hydrocracking of multiple feedstocks. Petroleum refiners often produce desirable products, such as turbine fuel, diesel fuel and other products known as middle distillates, as well as lower boiling hydrocarbonaceous liquids, such as naphtha and gasoline, by hydrocracking a hydrocarbon feedstock derived from crude oil or heavy fractions thereof. Feedstocks most often subjected to hydrocracking are the gas oils and heavy gas oils recovered from crude oil by distillation. A typical heavy gas oil comprises a substantial portion of hydrocarbon components boiling above 371° C. (700° F.) usually at least about 50% by weight boiling above 371° C. (700° F.). A typical vacuum gas oil normally has a boiling point range between 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalyst within a hydrocracking reactor influence the yield of the hydrocracked products.

Traditionally, the fresh feedstock for a hydrocracking process is first introduced into a denitrification and desulfurization reaction zone particularly suited for the removal of sulfur and nitrogen contaminants and subsequently introduced into a hydrocracking zone containing hydrocracking catalyst. Another method of hydrocracking a fresh feedstock is to introduce the fresh feedstock and the effluent from the hydrocracking zone into the denitrification and desulfurization zone. The resulting effluent from the hydrocracking zone is separated to produce desired hydrocracked products and unconverted feedstock which is then introduced into the hydrocracking zone.

Although a wide variety of process flowschemes, operating conditions and catalysts have been used in commercial activities, there is always a demand for new hydrocracking methods which provide lower costs, higher liquid product yields, higher quality products and the ability to simultaneously process a variety of different hydrocarbon feedstocks.

INFORMATION DISCLOSURE

U.S. Pat. No. 3,328,290 B1 (Hengstebeck) discloses a two-stage process for the hydrocracking of hydrocarbons in which the feed is pretreated in the first stage.

U.S. Pat. No. 5,980,729 B1 (Kalnes et al.) discloses a hydrocracking process wherein a hydrocarbonaceous feedstock and a hot hydrocracking zone effluent containing hydrogen is passed to a denitrification and desulfurization reaction zone to produce hydrogen sulfide and ammonia to thereby clean up the fresh feedstock. The resulting hot uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream.

U.S. Pat. No. 5,403,469 B1 (Vauk et al.) discloses a parallel hydrotreating and hydrocracking process. Effluent from the two processes are combined in the same separation vessel and separated into a vapor comprising hydrogen and a hydrocarbon containing liquid.

U.S. Pat. No. 6,106,694 (Kalnes et al.) discloses a hydrocracking process wherein a hydrocarbonaceous feedstock and a hot hydrocracking zone effluent is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream containing unconverted feedstock. This liquid hydrocarbonaceous stream is subsequently introduced into the hydrocracking zone to produce an effluent which is subsequently introduced into the denitrification and desulfurization reaction zone as described hereinabove.

BRIEF SUMMARY OF THE INVENTION

The present invention is a process for simultaneously hydrocracking multiple feedstocks wherein a first feedstock is hydrotreated in a hydrotreating zone to produce a hydrotreating zone effluent which is separated to provide a first vaporous hydrocarbonaceous stream and a first liquid hydrocarbonaceous stream. A second feedstock and the first vaporous hydrocarbonaceous stream are hydroprocessed in a hydroprocessing zone to produce a hydroprocessing zone effluent. A third feedstock and the first liquid hydrocarbonaceous stream are hydrocracked in a hydrocracking zone to produce a hydrocracking zone effluent. The hydrocracking zone effluent and the hydroprocessing zone effluent are separated to recover hydrocracked hydrocarbons.

BRIEF DESCRIPTION OF THE DRAWING

The drawing is a simplified process flow diagram of a preferred embodiment of the present invention. The above described drawing is intended to be schematically illustrative of the present invention and is not to be a limitation thereof.

DETAILED DESCRIPTION OF THE INVENTION

Figure 1:
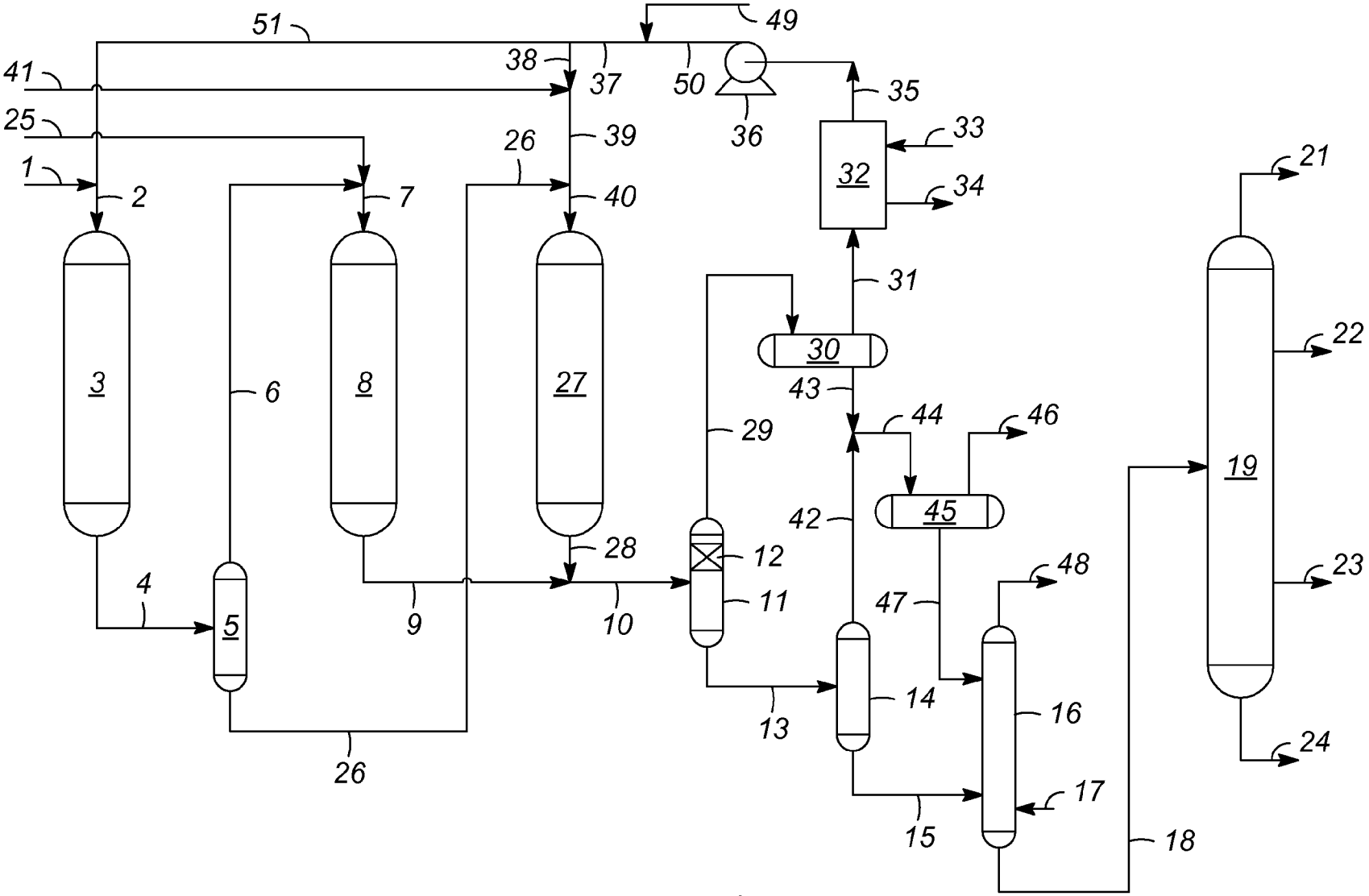

The process of the present invention is particularly useful to upgrade deasphalted oil, low-cetane distillate and vacuum gas oil feedstocks into high-centane diesel, reformer-quality naphtha, and high-quality fluid catalytic cracking feedstock with a single hydroprocessing unit.

One of the preferred multiple feedstocks utilized in the process of the present invention comprises deasphalted oil which is produced by solvent deasphalting a heavy residual hydrocarbon stream containing asphaltene compounds, such as atmospheric column bottoms or vacuum column bottoms, for example. The production of deasphalted oil is well known to those skilled in the art of petroleum processing and typically contains 50% or more boiling at a temperature greater than 565° C. (1050° F.). Briefly, solvent deasphalting (SDA) permits practical recovery of heavier oil, at relatively low temperatures, without cracking or degradation of heavy hydrocarbons. SDA separates hydrocarbons according to their solubility in a liquid solvent, as opposed to volatility in distillation. Lower molecular weight and most paraffinic components are preferentially extracted. The least soluble materials are high molecular weight and most aromatic components. This makes the deasphalted oil (DAO) extract light and paraffinic, and the asphalt raffinate heavy and aromatic. Suitable solvents for SDA include propane and higher molecular weight paraffins, such as butane and pentane, for example. The deasphalted oil generally contains metal compounds as well as high molecular weight hydrocarbons. In accordance with the present invention, the feedstock comprising deasphalted oil is introduced into a hydrotreating zone containing hydrotreating catalyst and operated at hydrotreating conditions sufficient to reduce the level of metal compounds, sulfur compounds and high molecular weight hydrocarbons.

Another one of the preferred feedstocks utilized in the process of the present invention comprises atmospheric gas oil (AGO) which is preferably produced by the fractionation of petroleum crude oil in an atmospheric distillation or fractionation column. Atmospheric gas oil preferably boils in the range from about 177° C. (350° F.) to about 427° C. (800° F.).

Yet another of the preferred feedstocks comprises vacuum gas oil which is preferably produced by the fractionation of petroleum crude oil in a vacuum distillation column. Vacuum gas oil preferably boils in the range from about 343° C. (650° F.) to about 565° C. (1050° F.).

In accordance with the present invention, the feedstock containing deasphalted oil is introduced into a hydrotreating zone containing hydrotreating catalyst. The hydrotreating zone is preferably operated at a temperature from about 204° C. (400° F.) to about 482° C. (900)° F.) and a pressure from about 3.5 MPa (500 psig) to about 20.8 MPa (3000 psig).

The term "hydrotreating" as used herein refers to processes wherein a hydrogen-containing treat gas is used in the presence of suitable catalysts which are primarily active for the removal of heteroatoms, such as sulfur, nitrogen and metals and for some hydrogenation of aromatic compounds. Suitable hydrotreating catalysts for use in the present invention are any known conventional hydrogenation catalysts and include those which are comprised of at least one Group VIII metal, preferably iron, cobalt and nickel, more preferably cobalt and/or nickel, and at least one Group VIB metal, preferably molybdenum and tungsten, on a high surface area support material, preferably alumina. It is within the scope of the present invention that more than one type of hydrotreating catalyst may be used in the same hydrotreating zone or vessel. The Group VIII metal is typically present in an amount ranging from about 2 to about 20 wt %, preferably from about 4 to about 12 wt %. The Group VIB metal will typically be present in an amount ranging from about 1 to about 25 wt % preferably from about 2 to about 25 wt %.

The resulting effluent from the hydrotreating reaction zone is transferred into a separator such as a hot high pressure vapor liquid separator maintained at essentially the same pressure as the hydrotreating reaction zone to produce a first gaseous hydrocarbonaceous stream containing hydrocarbonaceous compounds, hydrogen sulfide and ammonia, and a first liquid hydrocarbonaceous stream containing hydrocarbonaceous compounds having a reduced concentration of sulfur, nitrogen and metals. The hot high pressure vapor liquid separator is preferably operated and maintained at a temperature from about 204° C. (400° F.) to about 482° C. (900° F.) and a pressure from about 3.5 MPa (500 psig) to about 20.8 MPa (3000 psig). By maintaining the pressure of the hot vapor liquid separator at essentially the same pressure as the hydrotreating reaction zone it is meant that any difference in pressure is due to the pressure drop required to flow the effluent stream from the hydrotreating zone to the hot vapor liquid separator. It is preferred that the pressure drop is less than about 0.8 MPa (100 psig).

The gaseous hydrocarbonaceous stream containing hydrocarbonaceous compounds, hydrogen sulfide and ammonia is removed from the hot vapor liquid separator and is admixed with a second feedstock comprising atmospheric gas oil and the resulting admixture is introduced into a hydroprocessing zone. The hydroprocessing zone may contain one or more beds of the same or different catalysts. In the process of the present invention, hydroprocessing is selected from the group consisting of hydrotreating and hydrocracking. In one embodiment, when the preferred products are middle distillates, the preferred hydroprocessing catalysts utilize amorphous bases or low-level zeolite bases combined with one or more Group VIII or Group VIB metal hydrogenating components. In another embodiment when the preferred products are in the gasoline boiling range, the hydroprocessing zone contains a catalyst which comprises in general any crystalline zeolite cracking base upon which is deposited a minor portion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations, such as sodium, magnesium, calcium and rarer metals. They are further characterized by crystal pores of relatively uniform diameter between 4 and 14 Angstroms ($10^{-10}$ meters). It is preferred to employ zeolites having a relatively high silica to alumina mole ratio between about 3 and 12. Suitable zeolites found in nature include, for example, mordenite and faujasite. Suitable synthetic zeolites include, for example, the B, X, Y and L crystal types, for example, synthetic faujasite and mordenite. The preferred zeolites are those having crystal pore diameters between about 8-12 Angstroms, wherein the silica to alumina mole ratio is about 4 to 6. The zeolites which are preferably used for the base of hydrocracking catalysts in the present invention are readily commercially available.

The active metals employed in the preferred hydroprocessing catalysts of the present invention as hydrogenation components are those of a Group VIII, i.e. iron, cobalt, nickel, ruthenium, rhodium, palladium, osmium, iridium and platinum. In addition to these metals, other promoters may also be employed in conjunction therewith, including the metals of Group VIB, e.g. molybdenum and tungsten. The amount of hydrogenating metal in the catalyst can vary within wide ranges. Broadly speaking, any amount between about 0.05% and 30% by weight may be used. In the case of the noble metals, it is normally preferred to use about 0.05 to about 2 wt. %. The preferred method for incorporating the hydrogenating metal is to contact the base material with an aqueous solution of a suitable compound of the desired metal wherein the metal is present in a cationic form. Following the addition of the selected hydrogenating metal or metals, the resulting catalyst powder is then filtered, dried, pelleted with added lubricants, binders or the like if desired, and calcined in air at a temperature of, for example, 371° C.-648° C. (700° F.-1200° F.) in order to activate the catalyst and decompose ammonium ions. Alternatively the base may first be pelleted followed by the addition of the hydrogenating component and activation by calcining. The foregoing catalysts may be employed in undiluted form or the powdered zeolite catalyst may be mixed and copelleted with other relatively less active catalysts, diluents or binders, such as alumina, silica gel, silica-alumina cogels, activated clays and the like, in proportions ranging between 5 and 90 wt %. These diluents may be employed as such or they may contain a minor proportion of an added hydrogenated metal, such as Group VIB and/or Group VIII metal.

The hydroprocessing is conducted in the presence of hydrogen and preferably at hydroprocessing reactor conditions which include a temperature from about 204° C. (400° F.) to about 482° C. (900° F.) and a pressure from about 3.5 MPa (500 psig) to about 20.8 MPa (3000 psig). In addition, hydroprocessing conditions may include a liquid hourly space velocity from about 0.1 to about 30 $hr^{-1}$ and a hydrogen circulation rate from about 337 normal $m^3/m^3$ (2,000 standard cubic feet per barrel) to about 4200 normal $m^3/m^3$ (25,000 standard cubic feet per barrel).

The resulting effluent from the hydroprocessing zone is transported into a second separator such as a hot vapor liquid separator to provide a vaporous hydrocarbonaceous stream containing hydrogen, and a liquid hydrocarbonaceous stream. The vaporous hydrocarbonaceous stream from the second hot vapor liquid separator is, in one embodiment, passed through a bed of hydrotreating catalyst positioned in the upper end of the hot vapor liquid separator in order to further purify the vaporous hydrocarbonaceous stream in order to reduce the concentration of sulfur compounds.

The resulting liquid hydrocarbonaceous stream from the first hot vapor liquid separator is transported and admixed with a third hydrocarbonaceous feedstock containing vacuum gas oil and the resulting admixture is introduced into a hydrocracking zone. This hydrocracking zone may contain the same or different hydrocracking catalysts used in the hydroprocessing zone. In any event, any known convenient hydrocracking catalyst may be selected for use in the hydrocracking zone. The hydrocracking reaction conditions in the hydrocracking zone are preferably selected from a temperature from about 204° C. (400° F.) to about 482° C. (900° F.) and a pressure from about 3.5 MPa (500 psig) to about 20.8 MPa (3000 psig). The operating conditions selected for the hydrocracking zone may be the same or different as those in the hydroprocessing zone.

The resulting effluent from the hydrocracking zone is introduced, along with the hereinabove described effluent from the hydroprocessing zone, into the second hot vapor liquid separator. The second hot vapor liquid separator is preferably operated at a pressure from about 3.5 MPa (500 psig) to about 20.8 MPa (3000 psig) and a temperature from about 204° C. (400° F.) to about 482° C. (900° F.). The hydrotreating catalyst contained in the second hot vapor liquid separator may be selected from any of the hydrotreating catalysts described hereinabove or any other known hydrotreating catalysts.

The resulting effluent from the second hot vapor liquid separator is cooled and partially condensed and introduced into a separator such as a cold vapor liquid separator. The cold vapor liquid separator is preferably operated at a pressure from about 3.5 MPa (500 psig) to about 20.8 MPa (3000 psig) and a temperature from about 15.6° C. (60° F.) to about 65° C. (150° F.).

A hydrogen-rich gaseous stream is removed from the cold vapor liquid separator to provide a majority of the hydrogen introduced into the hydrotreating zone, the hydroprocessing zone and the hydrocracking zone. In the preferred embodiment of the present invention, the hydrogen-rich gaseous stream is scrubbed with a lean aqueous amine scrubbing solution, such as monoethanolamine, for example, to remove at least a significant portion of the hydrogen sulfide contained therein. Makeup hydrogen may be introduced into the process at any convenient location to replace the hydrogen consumed in the hydrotreating reaction zone and the hydrocracking zones. A liquid hydrocarbonaceous stream is removed from the cold vapor liquid separator and introduced into a cold flash drum to produce a vaporous stream containing hydrogen and normally gaseous hydrocarbon compounds. The cold flash drum is preferably operated at a temperature from about 32° C. (90° F.) to about 65° C. (150° F.) and a pressure from about 1.5 kPa (200 psig) to about 3.6 kPa (500 psig). A liquid hydrocarbonaceous stream is removed from the second hot vapor liquid separator and introduced into a hot flash drum operated at a temperature from about 204° C. (400° F.) to about 482° C. (900° F.) and a pressure from about 1.5 kPa (200 psig) to about 3.6 kPa (500 psig). A resulting vaporous hydrocarbonaceous stream is removed from the hot flash drum, partially condensed and introduced into the hereinabove described cold flash drum. A liquid hydrocarbonaceous stream is removed from the hot flash drum and introduced into the hereinabove identified stripper. A liquid stream is preferably removed from the stripper and introduced into a fractionation zone to preferably produce a naphtha stream, a kerosene stream and ultra-low sulfur diesel stream, and a vacuum gas oil stream. The fractionation zone or fractionator may be selected from known conventional petroleum fractionation zones which are well known to those skilled in the art.

DETAILED DESCRIPTION OF THE DRAWING

Referring now to FIG. 1, a deasphalted oil feedstock is introduced into the process via line 1 and is admixed with a hydrogen-rich gaseous stream provided via line 51 and the resulting admixture is carried via line 2 and introduced into hydrotreating zone 3. A resulting effluent from hydrotreating zone 3 is carried via line 4 and introduced into hot vapor liquid separator 5 to produce via line 6 an overhead gaseous stream comprising hydrocarbons, hydrogen sulfide and ammonia, and a liquid hydrocarbonaceous stream carried via line 26. An atmospheric gas oil feedstock is introduced into the process via line 25 and is admixed with the hereinabove described vaporous stream carried via line 6 and the resulting admixture is transported via line 7 and introduced into hydrocracking zone 8. A resulting effluent from hydrocracking zone 8 is carried via line 9 and admixed with a hereinafter described effluent carried via line 28 and the resulting admixture is transported via line 10 and introduced into hot vapor liquid separator 11. A vacuum gas oil feedstock is introduced into the process via line 41 and is admixed with a hydrogen-rich gaseous stream provided via line 38 and the resulting admixture is carried via line 39 and is joined by the hereinabove described liquid hydrocarbonaceous stream carried via line 26 and the resulting admixture is carried via line 40 and introduced into hydrocracking zone 27. An effluent from hydrocracking zone 27 is carried via line 28 and is introduced by lines 28 and 10 into hot vapor liquid separator 11 as described hereinabove. A gaseous hydrocarbonaceous stream containing hydrogen sulfide is passed upwardly through hot vapor liquid separator 11 and passes through an optional hydrotreating catalyst zone 12 and is removed therefrom via line 29. The gaseous stream carried via line 29 is cooled and partially condensed by heat exchange means not shown and the resulting cooled stream is introduced into cold vapor liquid separator 30. A hydrogen-rich gaseous stream containing hydrogen sulfide is removed from cold vapor liquid separator 30 via line 31 and introduced into absorber 32. A lean aqueous amine solution is introduced via line 33 into absorber 32 and is contacted with a flowing gas stream to absorb hydrogen sulfide, and a rich aqueous amine absorption solution containing hydrogen sulfide is removed from absorption zone 32 via line 34 and recovered. A hydrogen-rich gaseous stream having a reduced concentration of hydrogen sulfide is removed from absorption zone 32 via line 35 is compressed in compressor 36, carried via line 50 and is admixed with a makeup hydrogen stream provided via line 49 and the resulting admixture is carried via line 37. A hydrogen-rich gaseous stream is carried via lines 37, 38, 39 and 40 and introduced into hydrocracking zone 27 as hereinabove described. Another hydrogen-rich gaseous stream is carried via lines 37 and 51 and introduced into hydrotreating zone 3 as hereinabove described. The hydrogen-rich gaseous stream may also be added to line 6 (not shown). A liquid hydrocarbonaceous stream is removed from cold vapor liquid separator 30 and is carried via lines 43 and 44 and introduced into cold flash drum 45. A liquid hydrocarbonaceous stream is removed from hot vapor liquid separator 11 via line 13 and introduced into hot flash drum 14. A vaporous hydrocarbonaceous stream is removed from hot flash drum 14 via line 42 and is carried via lines 42 and 44 and introduced into cold flash drum 45. A vaporous stream comprising hydrogen and normally gaseous hydrocarbon is removed from cold flash drum 45 via line 46 and recovered. A liquid hydrocarbonaceous stream is removed from hot flash drum 14 via line 15 and introduced into stripper 16. A liquid hydrocarbonaceous stream is removed from cold flash drum 45 via line 47 and introduced into stripper 16. A gaseous stream containing normally gaseous hydrocarbons is removed from stripper 16 via line 48 and recovered. Steam is provided to stripper 16 via line 17. A liquid hydrocarbonaceous stream is removed from stripper 16 via line 18 and introduced into fractionation zone 19. A naphtha hydrocarbon stream is carried via line 21 and a kerosene stream carried via line 22 are removed from fractionation zone 19 and recovered. An ultra-low sulfur diesel stream is carried via line 23 and is removed from fractionation zone 19 and recovered. A liquid hydrocarbonaceous stream containing vacuum gas oil is removed from fractionation zone 19 via line 24 and recovered.

The foregoing description and drawing clearly illustrate the advantages encompassed by the process of the present invention and the benefits to be afforded with the use thereof.

What is claimed is:

1. A process for simultaneously hydrocracking multiple feedstocks which process comprises:

(a) hydrotreating a first feedstock comprising deasphalted oil (DAO), having a first total metal compound concentration, in a hydrotreating zone having a catalyst and operating conditions effective for reducing the first total metal compound concentration, wherein i) the hydrotreating zone produces a hydrotreated (HT) DAO effluent comprising a HT DAO effluent mixture of at least a HT DAO liquid and a HT DAO gas, and ii) the HT DAO effluent mixture has a second total metal compound concentration that is less than first total metal compound concentration of the DAO;

(b) separating the HT DAO effluent mixture in a HT DAO separation zone to provide a HT DAO vapor stream and a HT DAO liquid stream;

(c) hydroprocessing a second feedstock comprising atmospheric gas oil (AGO) and the HT DAO vapor stream from step (b) in a first hydroprocessing zone to produce a hydroprocessed (HP) effluent mixture comprising the product of a hydroprocessed AGO/HT DAO vapor mixture;

(d) hydrocracking a third feedstock comprising vacuum gas oil (VGO) and the HT DAO liquid stream from the HT DAO separation zone of step (b) in a hydrocracking zone to produce a hydrocracked (HC) effluent mixture comprising the product of a hydrocracked VGO/HT DAO liquid mixture;

(e) introducing the HP effluent mixture and HC effluent mixture into a second separation zone; and (f) recovering hydrocracked hydrocarbons.

2. The process of claim 1 wherein the HT DAO separation zone is a hot vapor liquid separator.

3. The process of claim 2 wherein the hot vapor liquid separator is operated at a pressure from about 3.5 MPa (500 psig) to about 20.8 MPa (3000 psig) and a temperature from about 204° C. (400° F.) to about 482° C. (900° F.).

4. The process of claim 1 wherein the second separation zone is a hot vapor liquid separator.

5. The process of claim 4 wherein the hot vapor liquid separator is operated at a pressure from about 3.5 MPa (500 psig) to about 20.8 MPa (3000 psig) and a temperature from about 204° C. (400° F.) to about 482° C. (900° F.).

6. The process of claim 4 wherein the second hot vapor liquid separator contains hydrotreating catalyst.

7. The process of claim 1 wherein the hydrocracking zone is operated at a temperature from about 204° C. (400° F.) to about 482° C. (900° F.) and a pressure from about 3.5 MPa (500 psig) to about 20.8 MPa (3000 psig).

8. The process of claim 1 wherein the hydroprocessing zone in step (c) is selected from the group consisting of a hydrotreating zone and a hydrocracking zone.

* * * * *